US011232677B2

(12) United States Patent
Burgstaller et al.

(10) Patent No.: US 11,232,677 B2
(45) Date of Patent: Jan. 25, 2022

(54) GAMING SYSTEMS WITH JACKPOT FEATURE

(71) Applicant: Novomatic AG, Gumpoldskirchen (AT)

(72) Inventors: Juergen Burgstaller, Marein-Feistritz (AT); Miha Stegel, Kanal (SI); Matjaz Urlep, Radomlje (SI)

(73) Assignee: Novomatic AG, Gumpoldskirchen (AT)

( * ) Notice: Subject to any disclaimer, the term of this patent is extended or adjusted under 35 U.S.C. 154(b) by 1 day.

(21) Appl. No.: 16/779,094

(22) Filed: Jan. 31, 2020

(65) Prior Publication Data

US 2021/0241577 A1 Aug. 5, 2021

(51) Int. Cl.
*G07F 17/32* (2006.01)

(52) U.S. Cl.
CPC ..... *G07F 17/3258* (2013.01); *G07F 17/329* (2013.01)

(58) Field of Classification Search
CPC ..... G07F 17/3213; G07F 17/3258
See application file for complete search history.

(56) References Cited

U.S. PATENT DOCUMENTS 5,042,810 A 8/1991 Williams
5,788,573 A * 8/1998 Baerlocher ..... G07F 17/32 273/138.2
7,448,948 B2 * 11/2008 Hughs-Baird ..... G07F 17/32 273/138.1
8,282,461 B2 * 10/2012 Berman ..... G07F 17/3267 463/16
8,517,381 B2 8/2013 Bontempo et al.
9,613,485 B2 * 4/2017 Barragan ..... G07F 17/3213
2003/0060263 A1 * 3/2003 Pearce ..... A63F 5/00 463/17
2006/0178202 A1 * 8/2006 Hughes ..... G07F 17/3276 463/20
2016/0260281 A1 * 9/2016 Ashigaya ..... A63F 5/0094
2016/0300454 A1 * 10/2016 Uss ..... G07F 17/34
2021/0134122 A1 * 5/2021 Smith ..... G07F 17/3248

FOREIGN PATENT DOCUMENTS

EM 006710638-0001 A1 8/2019

* cited by examiner

*Primary Examiner* — David L Lewis
*Assistant Examiner* — Robert E Mosser
(74) *Attorney, Agent, or Firm* — EIP US LLP

(57) ABSTRACT

A gaming system comprises an acceptor for receiving a wager, a payout mechanism, a credit meter, at least one input device for receiving player input, a display and a processor. Two or more independently rotatable wheels are concentrically arranged with increasing diameters. Each wheel includes a set of unique symbols on its outer circumference. A first of the two or more wheels comprises a first number of positions on its outer circumference for selecting a first subset of the set of unique symbols when the first wheel has stopped. A second of the two or more wheels comprises a second number of positions on its outer circumference for selecting a second subset of the set of unique symbols when the second wheel has stopped. The symbols of the second subset of unique symbols also contained in the first subset of unique symbols are qualified for an award.

21 Claims, 13 Drawing Sheets

GAMING SYSTEMS WITH JACKPOT FEATURE

BACKGROUND

There is a constant need to provide new types of gaming machines and systems that attract users and keep users entertained.

Manufacturers, in order to make their gaming machines more popular, may use to increase the number and variety of winning combinations and provide more opportunities for the user to win. Providing more variety and opportunities holds the user's interest for a longer time and also enables the manufacturer to have a wider range of payouts for the winning combinations.

Current gaming machines provide secondary or bonus games in addition to primary games. These secondary or bonus games are generally different from the primary game. The secondary or bonus games are played separately from the primary game. For instance, secondary or bonus games may be evaluated with a different set of predetermined combinations of the gaming symbols and/or different paylines. Bonus games may also be completely different games.

U.S. Pat. No. 5,042,810 discloses a roulette game and an apparatus that includes a detector for detecting the winning number in each roulette game played on the wheel, a jackpot counter for storing a value representing an amount to be paid out upon the occurrence of a jackpot. The value in the counter is incremented as the play proceeds and is displayed on a display. A detector monitors the result of each game to determine whether a jackpot has occurred. The jackpot condition can be defined by the occurrence of the same winning number a fixed number of times such as, for example, three in a row and there may be a further jackpot to be paid out in accordance with a further jackpot condition.

U.S. Pat. No. 8,517,381 discloses a gaming table, method and device including a plurality of rotors interchangeably operable in a decoupled mode and a coupled mode. The system includes a rotor coupler and a coupler actuator. The system provides an award associated with an indication of a combination of symbols of the rotors.

DETAILED DESCRIPTION

Figure 1:
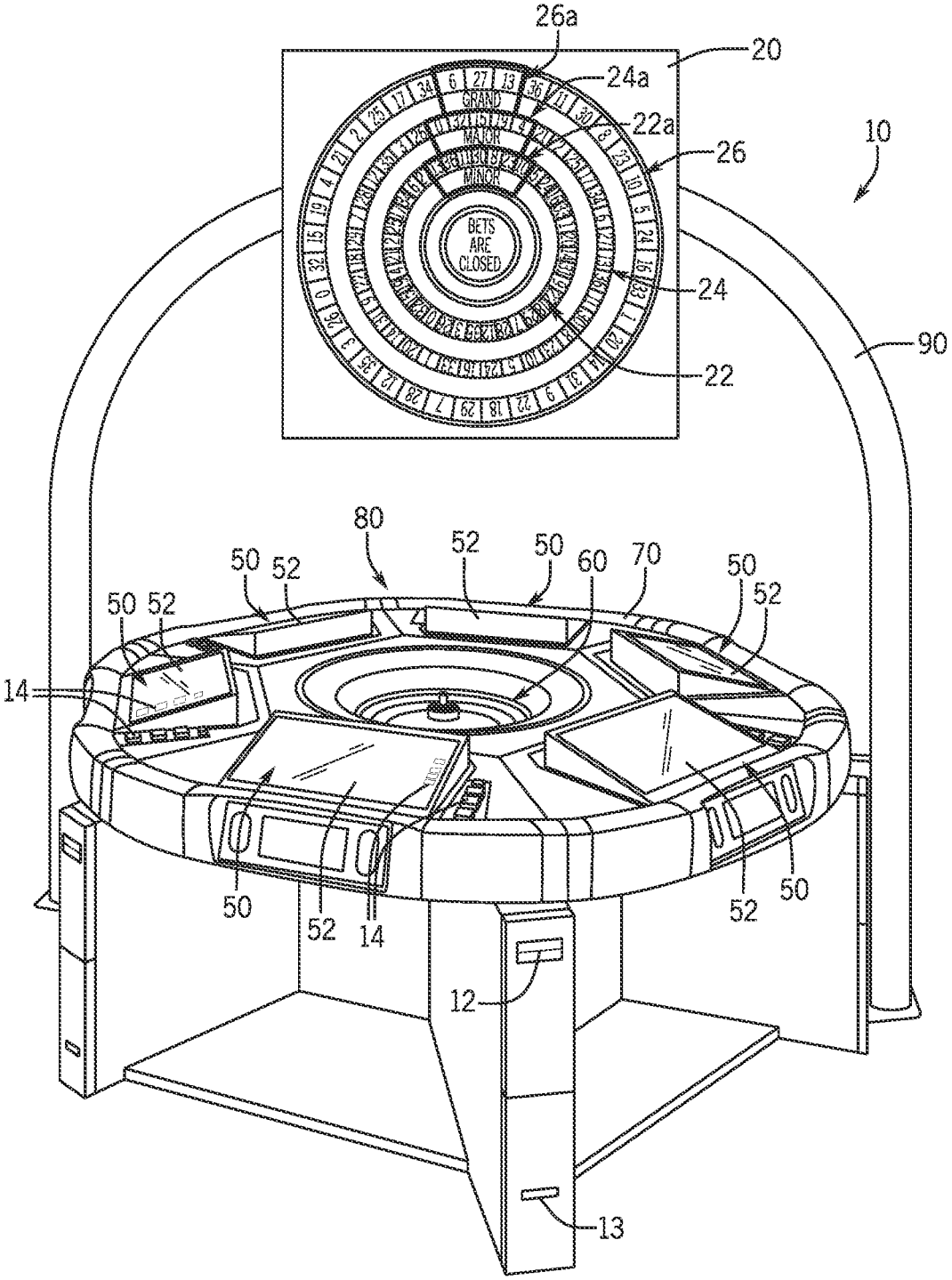
FIG. 1 illustrates an embodiment of a gaming system of the present disclosure having a jackpot feature.

The present disclosure relates to gaming systems, such as a roulette gaming system, comprising a roulette table with a roulette wheel. The roulette wheel may be laid out according to U.S. or U.K. (i.e., French/European) style, i.e. with two or one zeroes. The roulette wheel may be associated with a table management system which may comprise at least one suitably programmed computer or microcomputer, or in some examples, a dedicated microcontroller with associated display and keypad, and an optical number reader, which may read from the roulette wheel the number at which the ball comes to rest. A display may also be provided that displays the last few winning numbers drawn on the roulette wheel. It should accordingly be appreciated that in certain embodiments of the gaming systems herein include a computer having at least one processor and at least one memory device storing instructions (e.g., software), which when executed by the at least one processor operate with the gaming systems herein and their components to carry out various functions of the gaming system including games of chance played on the gaming systems.

According to an embodiment, a roulette gaming system comprises a display and a roulette game that is played according to conventional rules appropriate to the type of roulette wheel (US or UK) being used and is supplemented by a jackpot system or jackpot feature. In one embodiment, the jackpot feature comprises two or more rotatable wheels that are concentrically arranged with each wheel having an increasing diameter so that an outer circumference of each wheel is visible to players of the gaming system. A set of unique symbols, for example, numbers 0 to 36 according to U.K. style roulette, is depicted (i.e., visible) on the outer circumference of each of the two or more wheels. Each wheel may rotate independently from each of the other wheels around a common axis of rotation located in the center area of the multiple wheels.

In an embodiment, the two or more rotatable wheels comprises three wheels. The first, or innermost, wheel of the three rotatable wheels comprises a first number of positions on its outer circumference, e.g., the first wheel may have an associated seven positions, for selecting a first subset of the set of unique symbols when the first wheel has stopped. The first number of positions on the inner wheel may be displayed in a MINOR window of the first wheel. The second or middle wheel of the three rotatable wheels comprises a second number of positions on its outer circumference. In one example, the second wheel has an associated five positions for selecting a second subset of the set of unique symbols when the second wheel has stopped. The second number of positions on the inner wheel may be displayed in a MAJOR window of the second wheel. The third or outermost wheel of the three rotatable wheels comprises a third number of positions on its outer circumference. In one example, the third wheel has an associated three positions for selecting a third subset of the set of unique symbols when the third wheel has stopped. The third number of positions may be displayed in a GRAND window of the third wheel.

According to an embodiment, the jackpot feature comprises a MINOR jackpot (bonus), a MAJOR jackpot (bonus), and a GRAND jackpot (bonus), which may correspond to the MINOR, MAJOR and GRAND window displays, as described below. The MINOR jackpot is a first level award of a jackpot award and, in this embodiment, is a fixed amount awarded to every winner. The MAJOR jackpot is a second level award of the jackpot award and the GRAND jackpot is a third level award of the jackpot award. In this embodiment, the MAJOR jackpot and GRAND jackpot are progressive awards and may also be won by more than one player. However, if there are several winners of the progressive awards, the respective jackpot amount is split equally between the several winners. Alternatively, the split amount may be only a respective portion for each winner depending on one or more parameters, which parameters may be based on, for example, playing history of the respective winners (i.e., players who win the jackpot).

According to various embodiments, in addition to betting with regular chips for the roulette game, special jackpot chips (e.g., electronic chips) are provided to players. A jackpot chip may be placed on any straight-up number of the roulette betting area. In one embodiment, the jackpot chip placed on the roulette betting area may be shown under a regular chip used for the roulette play. The jackpot chip may only award jackpot wins. In one embodiment, a MINOR jackpot bonus may be won (e.g., payed out) if the following occurs: the jackpot chip is/was placed on a winning number field (determined by the number assigned to the pocket of the wheel where the roulette ball lands) and the winning number is one of the seven LUCKY NUMBERS in the Minor-Bonus-wheel-section (i.e., MINOR window of the first wheel). A MAJOR jackpot bonus may be won (e.g., payed out) if the following occurs: the jackpot chip is/was placed on the winning number field (determined by the number assigned to the pocket of the wheel where the roulette ball lands) and if the winning number is one of the seven LUCKY NUMBERS in the Minor-Bonus-wheel-section (i.e., MINOR window of the first wheel) and if the winning number is one of the five LUCKY NUMBERS in the Major-Bonus-wheel-section (i.e., MAJOR window of the second wheel). A GRAND jackpot bonus may be won (e.g., payed out) if the following matches: the jackpot chip is/was placed on the winning number field (determined by the number assigned to the pocket of the wheel where the roulette ball lands) and if the winning number is one of the seven LUCKY NUMBERS in the Minor-Bonus-wheel-section (i.e., MINOR window of the first wheel) and if the winning number is one of the five LUCKY NUMBERS in the Major-Bonus-wheel-section and if the winning number is one of the three LUCKY NUMBERS in the Grand-Bonus-wheel-section (i.e., GRAND window of the third wheel).

In an embodiment, to increase player-interest in the jackpot feature of the present disclosure, the amount(s) currently available in the jackpot fund(s) is/are displayed in the vicinity of the roulette table, which will be seen as increasing as the fund accumulates. As the fund accumulates, the percentage of the table turnover paid into the jackpot fund(s) may be varied, either increasing/upwards or decreasing/downwards. The proportion of funding of the jackpot may in certain embodiments be relatively high initially and then be reduced as the accumulated amount of the jackpot fund increases (as a compromise between promoting player-interest and economy). Once a jackpot has been paid out, the jackpot fund may be seen by the players as being replenished rapidly. To facilitate this rapid replenishment, in parallel with the displayed (public) jackpot fund, a hidden replacement fund (whose contents are not displayed to the players) is maintained and incremented in tandem with the displayed amount. This hidden replacement fund may be incremented on the basis of table-turnover in one embodiment, and in certain examples with the percentages paid into the public and hidden funds varying as the displayed amount increases (so that once that amount has reached a substantial level, the replacement fund can be rapidly increased in anticipation of being used to replace the amount paid out on occurrence of a pay-out).

According to an embodiment, a computer processor of the gaming system is programmed (e.g., programmed via instructions stored on at least one memory device and executed by the processor) to maintain in software six internal meters, one pair of meters for each of the three jackpots (e.g., the MINOR, MAJOR, and GRAND jackpots). The contents of the visible meters of the three jackpots are displayed on respective displays of the jackpot display. Each of the three jackpots has associated with it a further hidden meter that is not visible to the public but may be visible privately to a local operator, for example. These hidden meters may also be incremented at the end of each game by a percentage of the table turnover during the preceding game and be maintained so as to replenish the jackpot funds when one or other jackpot is paid out. The percentages of table turnover added to the public and hidden meters may either be selected by a program running on the gaming system computer, or alternatively percentages can be set by the operator by inputting the relevant values to the computer via the keypad associated with it.

In an embodiment, a play of a game of chance of the gaming system proceeds in accordance with conventional rules of roulette with the public and hidden meters being suitably incremented at the end of each play of a game. The computer may be programmed to detect the occurrence of a situation appropriate for pay out of the jackpot(s), such as the jackpot payouts described herein.

According to one embodiment of the present disclosure, two or more rotatable wheels of the jackpot system are mechanical wheels. In one example, electronic sensors are provided and may be arranged at specific positions of the gaming system, e.g., arranged at or near the MINOR, MAJOR, and GRAND windows of each of the rotatable wheels, to determine the set of unique symbols when the respective wheel has stopped. The gaming system may include hardware logic or software for controlling rotation and stopping of the respective rotatable wheels as well as for determining whether the winning number of the roulette wheel of the roulette table matches one of the symbols of the set of unique symbols qualified for an award and for processing the award (e.g. incrementing the credit meter by the award value).

Turning now to the figures, FIG. 1 illustrates one embodiment of a gaming system 10 of the present disclosure having a jackpot feature. Gaming system 10 comprises a plurality of individual player stations 50 (in the present example there are six player stations) and an automatic roulette wheel 60 embedded within a table 70. Roulette wheel 60 at or near the center of table 70 with plurality of player stations 50 forms an island or island-like table configuration 80. Thus, it should be appreciated that gaming system 10 in this embodiment may be a video automated six player gaming system station, forming the island configuration 80 via players stations 50 being coupled to, physically attached or integral with the centered roulette wheel 60. Other configurations for gaming system 10 are contemplated as well. For example, fewer or more than six player stations may be included, and the player stations 50 and roulette wheel 60 may be physically separated from each other in various examples.

Referring still to the embodiment of FIG. 1, each player station 50 of gaming system 10 is equipped with a player station display 52. Player stations displays 52 in various embodiments may be touchscreen monitors, such as full HD touchscreen monitors. Each player station display 52 may be individually tiltable in certain examples and may include automated cash handling. An arch 90, such as a light sign arch in the form of a portal, is coupled to table 70 (and hence island configuration 80) in a manner that spans across the top of table 70 (or island configuration 80) to create an arch or arch-like shape over island configuration 80. It should be appreciated that in various embodiments arch 90 need not be in the form of an arch or arch-like shape, however. Coupled to arch 90 is a jackpot display 20 for displaying information including the jackpot system or feature of the present disclosure. Jackpot display 20 is placed in a top or upper restriction region of arch 90 or portal but may be located in any suitable position that is visible to one or more players of gaming system 10. Jackpot display 20 may be any suitable display device that allows relevant game information to be shown to players of the plurality of player stations, such as the information regarding the jackpot feature, as described herein. In one example, jackpot display 20 may include multiple displays such as two separate display screens aligned toward opposite sides (e.g. back to back configuration). Certain embodiments of gaming system 10 may further include a video camera positioned to allow video recordings of the ball drawing within roulette wheel 60. In one example, the video camera may be coupled to a top portion of portal or arch 90 and may be directed towards roulette wheel 60 for generating video recordings of the ball drawing within roulette wheel 60. The recording(s) may be provided to individual player station displays 52 and/or the jackpot display 20 arranged at the arch 90.

It should be appreciated that in certain embodiments, gaming system 10 includes a computer with at least one processor and at least one memory device with instructions (i.e., software) that is executable by the processor. Gaming system 10 may further include an acceptor 12 for receiving a wager, e.g., a money and/or currency and/or bill and/or ticket acceptor 12 and for establishing a credit balance that can be increased or decreased depending upon wagering activity, one or more player activatable buttons 14 (which may also include buttons on the touchscreen) for receiving player input, one or more credit meters 16 configured to monitor and/or display credit balances of each player, and a payout mechanism for paying out any credit balance, e.g., via a ticket printer. It should also be appreciated that player activatable buttons may be any suitable player-activatable input device for receiving player input. For example, in one embodiment, the player-activatable buttons may be part of player station display 52 of each player station 50 and may be, for example, touch screen inputs on the touch screen monitors at each player station display 52. It should further be appreciated that in certain embodiments, the payout mechanism may be the same or substantially the same element as the acceptor 12 for accepting or receiving a wager.

According to a further embodiment the gaming system 10 is set-up as a cashless gaming system that includes a real-time gaming account wagering system operatively coupled to, inter alia, an enrollment station, a real-time accounting and game information system and a plurality of player stations 50. In this case, each player station 50 includes a controller assembly and a card reader assembly operatively coupled to the real-time gaming account wagering system. The card reader assembly includes a card reading means, a keypad and a display means. At the outset, the player establishes an electronic account at the enrollment station by selecting a personal identification number (PIN), depositing funds to an electronic account and receiving a player card which allows the player to access the real-time gaming account wagering system directly from any player station. The player can access credits at the player station 50 via the pin activated keypad. The player may be presented a menu that includes options which allow the player to review his/her electronic account balance, download a player selected amount of funds, up to all of the funds from the account to the player station 50 (receive funds), upload a player selected amount of credits from the player station to the electronic account (return funds). A biometric system may be provided in addition or instead of the card and card reader system.

FIGS. 2-11 illustrate an embodiment of a jackpot feature of the present disclosure, and a sequence of events that may occur during a game of chance played on the gaming system embodiment of FIG. 1. The jackpot feature in this example is displayed on a jackpot display 20 arranged or positioned at a top portion of gaming system arch 90 in FIG. 1. Jackpot display 20 here includes two separate displays, a first display facing in first direction, and a second display facing in a second direction opposite the first direction (the second display is not visible in FIG. 1) such that each player positioned at player stations 50 may view information displayed on jackpot display 20. Jackpot display 20 and its one or more screens may be positioned at any position on arch or portal 90, and at any angle visible to the players. Jackpot 20 may also be positioned physically separate from the portal or arch 90 in certain embodiments.

Figure 2:
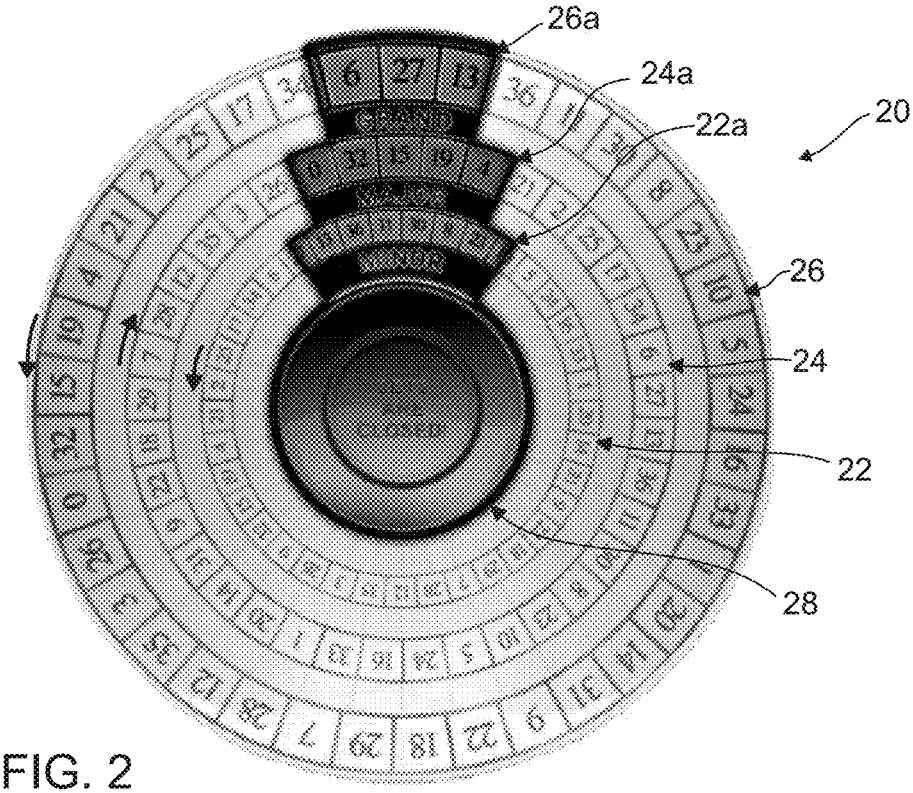
FIGS. 2-11 illustrate an embodiment of the jackpot feature of the present disclosure, and a sequence of events that may occur during a game of chance played on the gaming system of FIG. 1.

Referring now to FIG. 2 more specifically, FIG. 2 shows jackpot display 20 displaying three rotatable wheels 22, 24, 26 that are concentrically arranged and have increasing diameters so that an outer circumference of each of the three wheels 22, 24, 26 is visible. A set of unique symbols, numbers 0 to 36 according to U.K. style roulette, is depicted (visible) on the outer circumference of each of the three wheels 22, 24, 26. The three wheels 22, 24, 26 are rotatable independently from each other around a common axis of rotation in the center of the three wheels 22, 24, 26. The first or innermost wheel 22 comprises a first number of positions on its outer circumference, which in this embodiment includes an associated seven positions, for selecting a first subset of the set of unique symbols when the first wheel has stopped. The first number of positions on inner wheel 22 may be contiguously arranged and displayed in/as a MINOR window **22*a* of first wheel 22. The second or middle wheel 24 comprises a second number of positions on its outer circumference, which in this embodiment has an associated five positions, for selecting a second subset of the set of unique symbols when the second wheel has stopped. The second number of positions on the middle wheel 24 may be contiguously arranged and displayed in/as a MAJOR window 24*a* of second wheel 24. The third or outermost wheel 26 comprises a third number of positions on its outer circumference, which in this embodiment has an associated three positions for selecting a third subset of the set of unique symbols when the third wheel has stopped. The third number of positions on the outer wheel 26 may be contiguously arranged and displayed in/as a GRAND window 26*a* of third wheel 26. Jackpot display 20 in this embodiment also includes a display area 28 located within or at the center of the three wheels 22, 24, 26. Display area 28 in this example is smaller than the first inner rotatable wheel 22, e.g., has a smaller circumference when the display is circular. Display area 28 may be any suitable shape and be adapted for displaying any relevant gaming system information, e.g., status of a game of chance being played on the gaming system 10 and/or the operation of roulette wheel 60**, e.g., as a live video stream.

Figure 3:
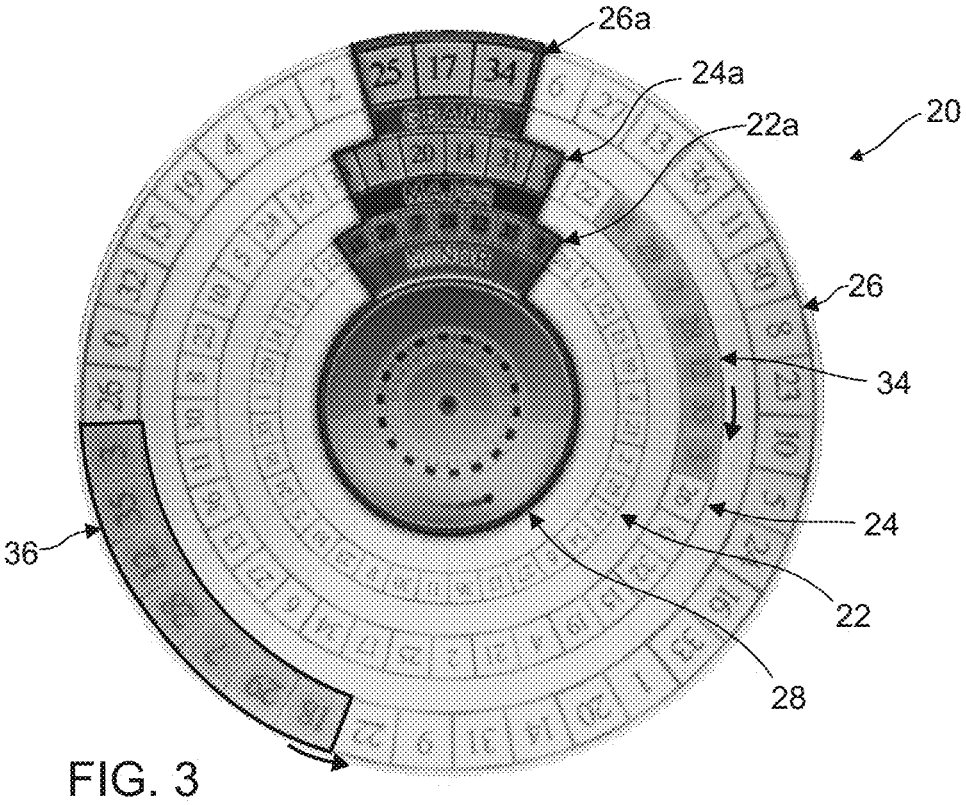
Figure 4:
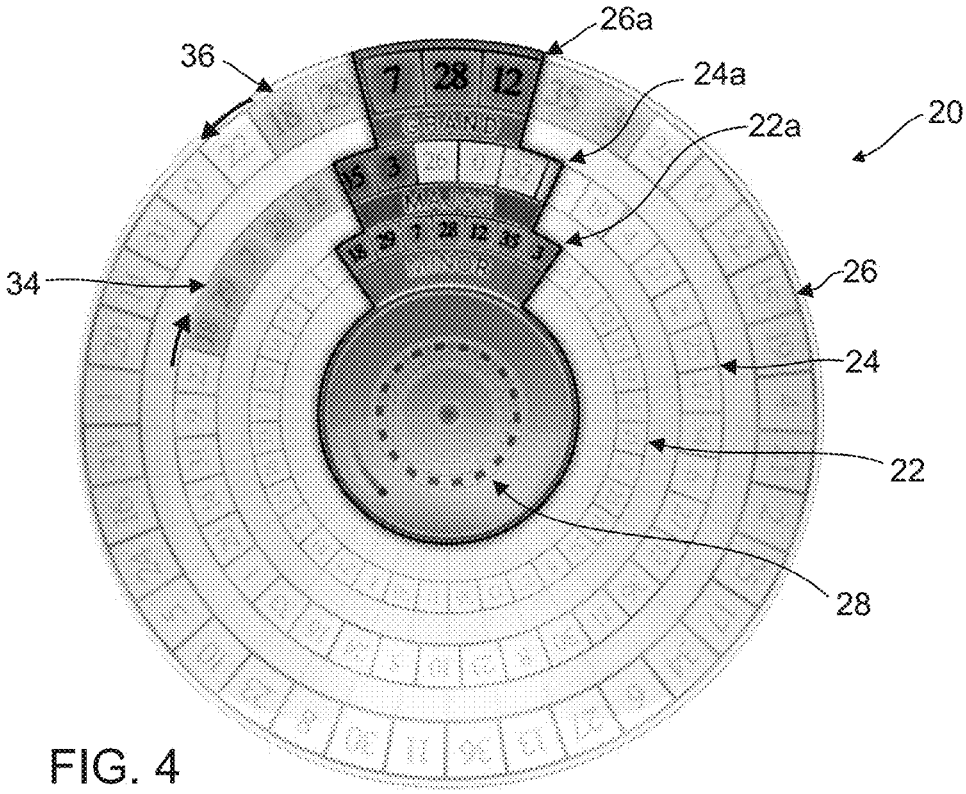
Figure 5:
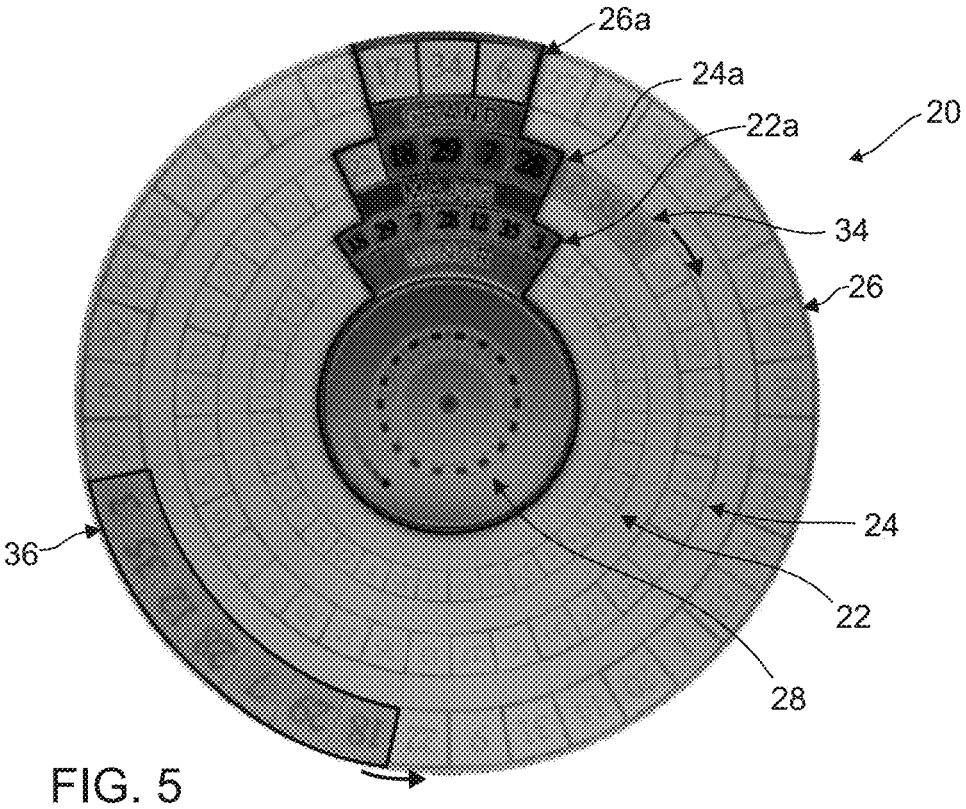

Turning now more specifically to an example sequence of events that may occur during a game of chance played on the gaming system illustrated at FIG. 1, FIG. 2 shows an example sequence of events starting with all three wheels 22, 24, 26 rotating, with first and third wheels 22, 26 rotating counterclockwise, while second wheel 24 rotates clockwise (see arrows in FIG. 2). FIG. 3 shows that the first wheel 22 is stopped, and the first subset of the set of unique symbols is displayed in MINOR window **22*a*. Here, the first subset determined are the numbers "18", "29", "7", "28", "12", "35", and "3". These symbols of the first subset of the set of unique symbols are qualified for a first award (i.e., MINOR jackpot). At the same time, jackpot display 20 displays the numbers of "18", "29", "7", "28", "12", "35", and "3" as highlighted on second wheel 24 and third wheel 26 (as illustrated by reference numerals 34 and 36, respectively), while the second 24 and third 26 wheels are still rotating. FIG. 4 illustrates that while first wheel 22 is stopped and third wheel 26 is rotating, second wheel 24 is slowing down and is about to run out or stop. FIG. 5 shows second wheel 24 is stopped, and the second subset of the set of unique symbols are displayed in MAJOR window 24***a*. The symbols of the second subset of the set of unique symbols that are also contained in the first subset of the set of unique symbols are qualified for a second award (i.e., MAJOR jackpot). Here, the second subset of symbols that are also contained in the first subset of symbols are numbers "18", "29", "7", and "28".

Figure 6:
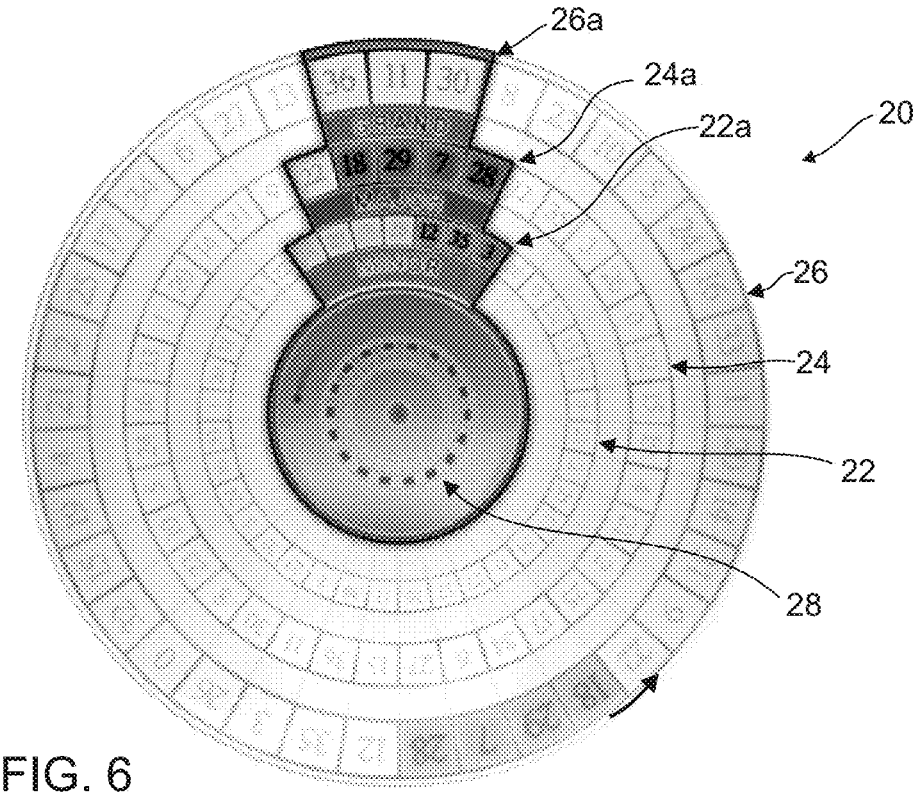
Figure 7:
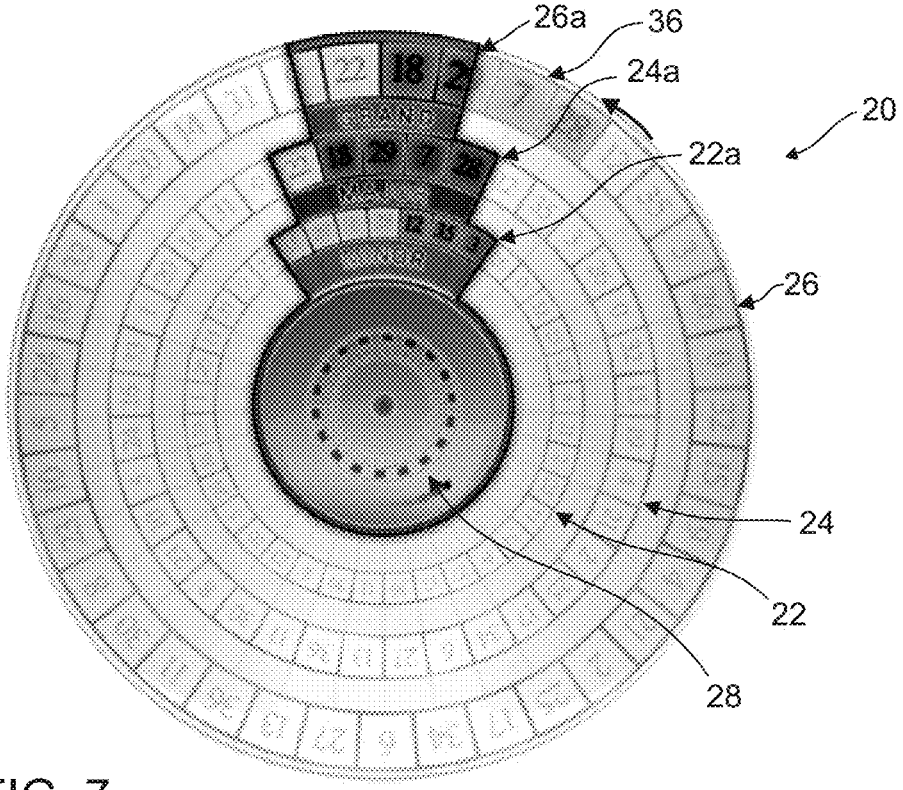
Figure 8:
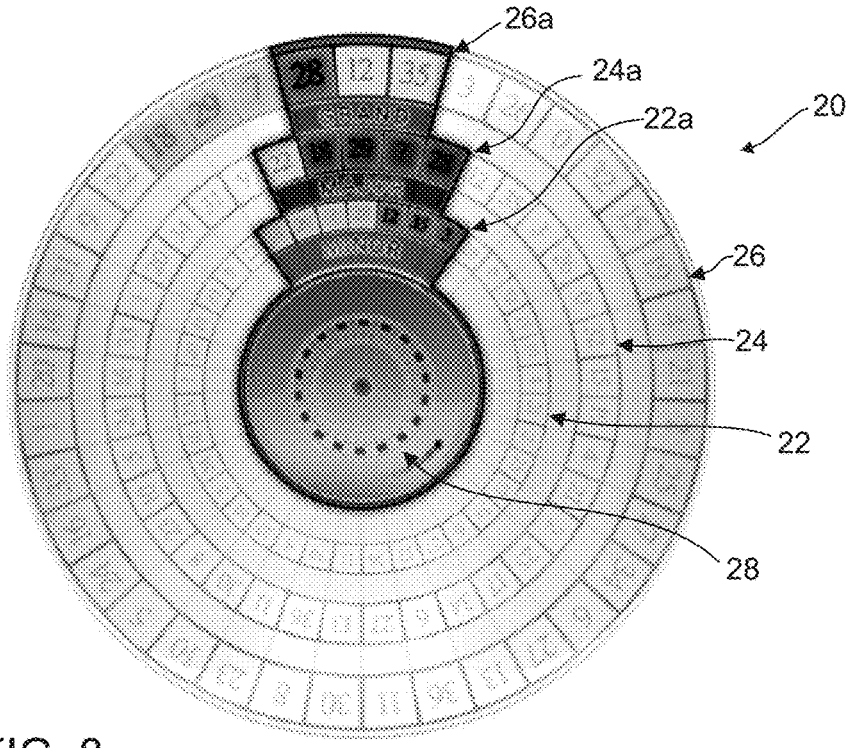

FIG. 6 shows that while first wheel 22 and second wheel 24 are stopped, third wheel 26 is still in rotation/spinning. FIG. 7 shows while first wheel 22 and second wheel 24 are stopped, third wheel 26 is slowing down and is about to run out or stop (while the rotatable wheels could stop abruptly in certain examples the wheels gradually slowdown of the rotation speed to increase the tension for the player). FIG. 8 shows that third wheel 26 is stopped and the third subset of the set of unique symbols are displayed in GRAND window 26*a*. The symbols of the third subset of the set of unique symbols that are also contained in the first subset and the second subset of the set of unique symbols are qualified for a third award (i.e., GRAND jackpot). In this case, it is the single number "28" that is qualified for the third award.

Figure 9:
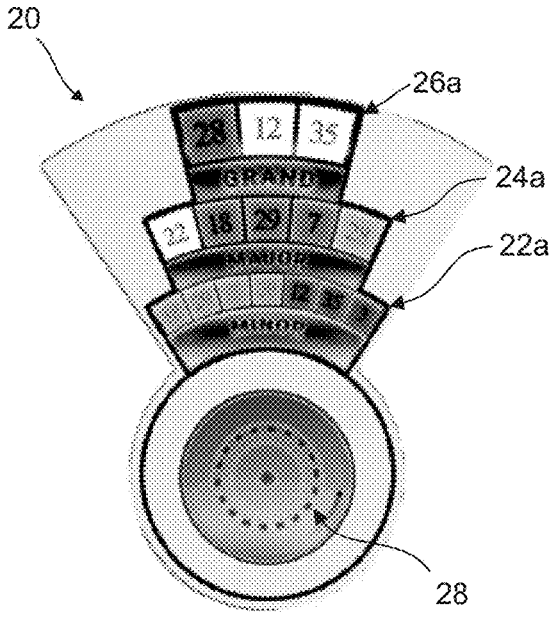
Figure 10:
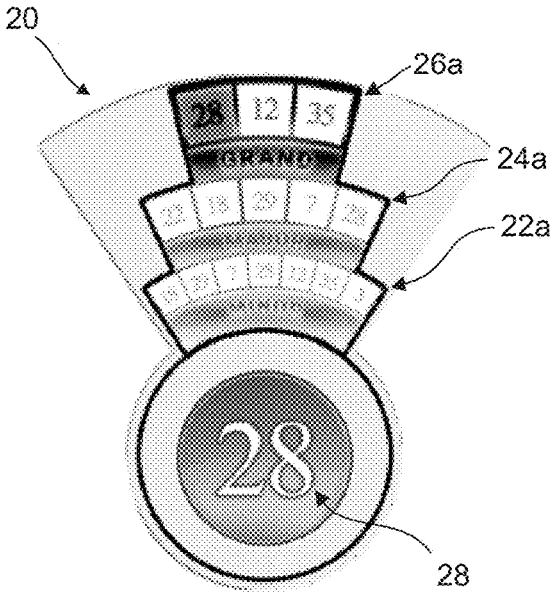

FIG. 9 shows that while each of first wheel 22, second wheel 24, and third wheel 26 is stopped, roulette wheel 60 of table 70 is slowing down and is about to run out or stop. In this embodiment, roulette wheel 60 is shown as a simulated wheel in display area 28 of jackpot display 20. FIG. 10 shows that while each of first wheel 22, second wheel 24, and third wheel 26 is stopped, roulette wheel 60 of table 70 has determined a winning number through the roulette ball landing in one of the possible fields (i.e., one of the pockets of roulette wheel 60). Thus, roulette wheel 60 is a random number generator ("RNG") which randomly determines a single symbol of the set of unique symbols. In this case, the number "28" has been drawn and is displayed in display area 28. Because the drawn number "28" is also one of the symbols of the third subset of the set of unique symbols which is qualified for the third award, the GRAND Jackpot bonus will be awarded (paid) to the respective player(s) that placed a jackpot chip for number 28.

Figure 11:
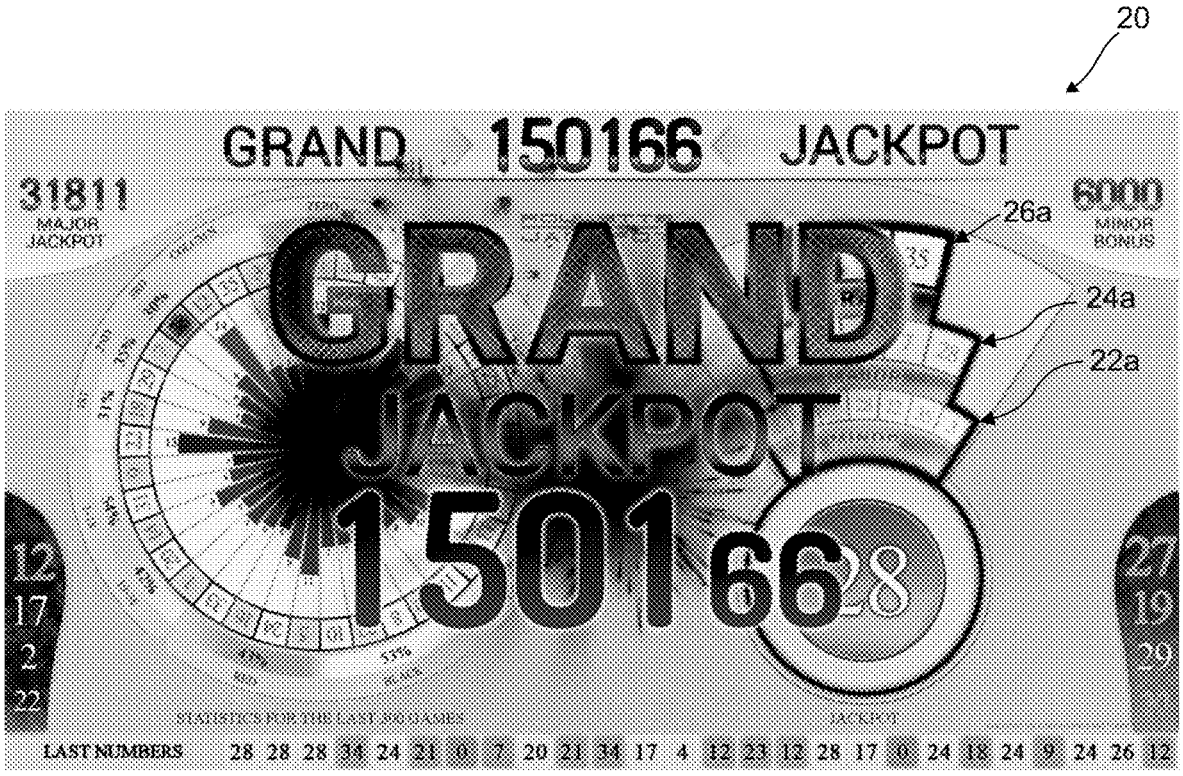

FIG. 11 shows jackpot display 20 displaying a GRAND jackpot having been awarded to a player that placed a jackpot chip on the number 28. It should be appreciated that a jackpot chip may be placed by players at their player stations 50 using, for example, one or more of the player-activatable input buttons or any other suitable player input device such as a touchscreen interface associated with, or part of, a respective player station display 52.

FIGS. 12-17 illustrate a further embodiment of a gaming system of the present disclosure having a jackpot feature, and a sequence of events that may occur during a game of chance played on the gaming system. Here, the jackpot feature is displayed at each respective player station display of each player station (e.g., at each player station display 52 of player stations 50 of island configuration 80 in the gaming system embodiment illustrated at FIG. 1). At the player stations 52, bets are placed (e.g., by player input such as touch screen operation on a touch display of the player stations) in the form of respective valued jetons to various fields of an electronic roulette betting field 56. In this example, jackpot chips 54 are placed on numbers "10", "25", "26", and "29".

Figure 12:
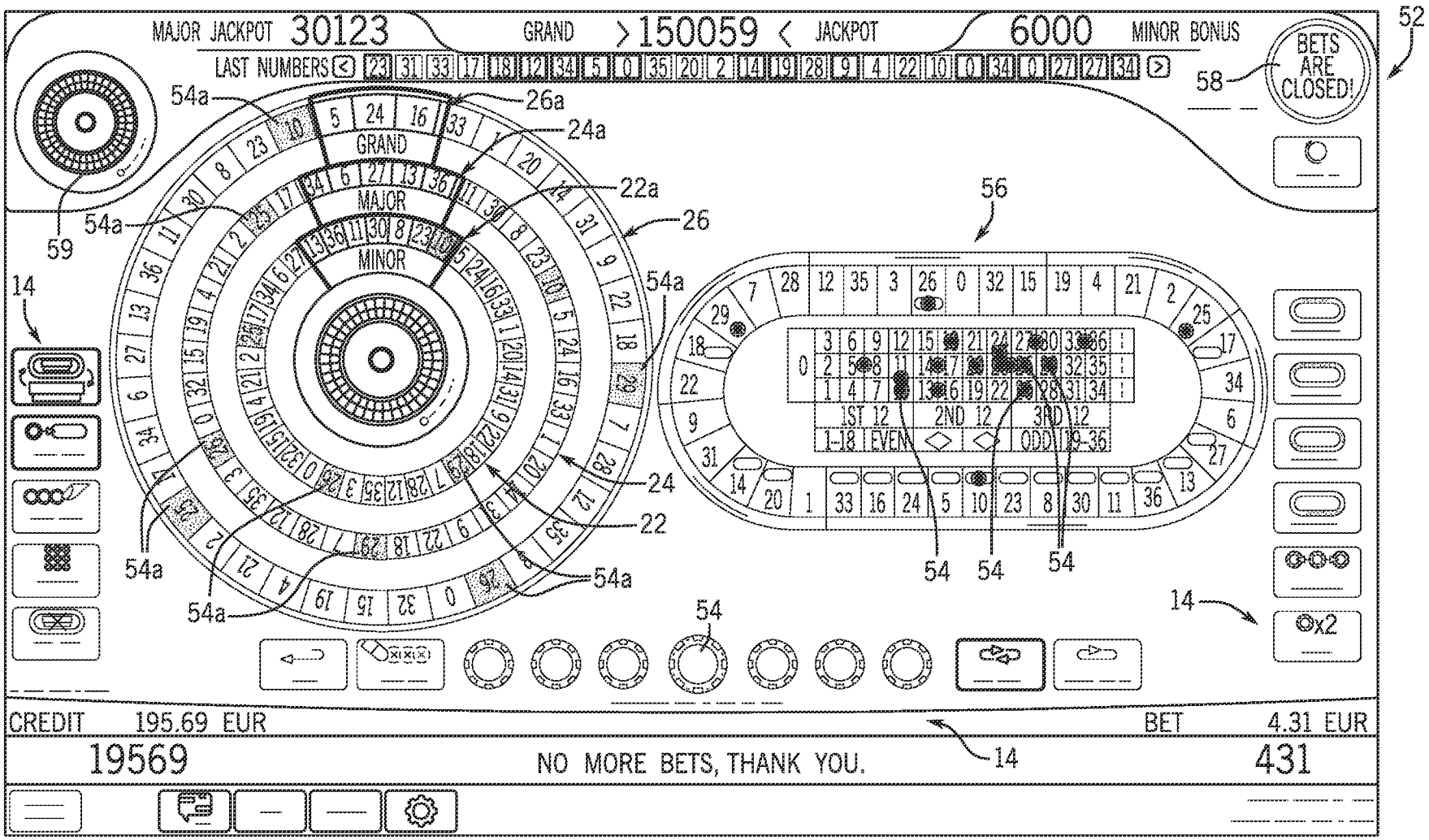
FIGS. 12-17 illustrate a further embodiment of a gaming system of the present disclosure having a jackpot feature, and a sequence of events that may occur during a game of chance played on the gaming system.

Referring to FIG. 12 more specifically now, FIG. 12 shows the jackpot feature having three rotatable wheels 22, 24, 26 (like the wheels illustrated in the embodiment of FIGS. 1-11), which are concentrically arranged and have increasing diameters so that an outer circumference of each wheel is visible. A set of unique symbols, numbers 0 to 36 according to U.K. style roulette, is depicted (visible) on the outer circumference of each wheel. Wheels 22, 24, 26 are rotatable independently from each other around a common axis of rotation in the center of the three rotatable wheels. The first or innermost wheel 22 comprises a first number of positions on its outer circumference, which in this embodiment includes an associated seven positions, for selecting a first subset of the set of unique symbols when the first wheel has stopped. The first number of positions on inner wheel 22 may be contiguously arranged and displayed in/as a MINOR window 22*a* of first wheel 22 (like MINOR window of FIGS. 1-11). The second or middle wheel 24 comprises a second number of positions on its outer circumference, which in this embodiment has an associated five positions, for selecting a second subset of the set of unique symbols when the second wheel has stopped. The second number of positions on middle wheel 24 may be contiguously arranged and displayed in/as a MAJOR window 24*a* of second wheel 24 (like the MAJOR window of FIGS. 1-11). The third or outermost wheel 26 comprises a third number of positions on its outer circumference, which in this embodiment has an associated three positions, for selecting a third subset of the set of unique symbols when third wheel 26 has stopped. The third number of positions on outer wheel 26 may be contiguously arranged and displayed in/as a GRAND window 26*a* of third wheel 26 (like the GRAND window of FIGS. 1-11). The placement of jackpot chips 54 on the numbers "10", "25", "26", and "29" are also indicated or highlighted on each of the rotatable wheels 22, 24, 26 as shown by element numbers 54*a* in FIG. 12. Player station display 52 displays that betting has lapsed or has been closed (as indicated in a betting status display area 58 shown at a right corner of player station display 52) and that a roulette wheel number drawing has started in that the roulette ball is brought into the roulette wheel (e.g., wheel 60 of island configuration 80 in the embodiment of FIG. 1) and circulates there (as known from conventional roulette play). Player station display 52 further displays a live video stream (captured by a camera) of the roulette draw in a roulette wheel display area 59 illustrated at the left upper corner of player station display 52. At the same time, the gaming system operates the jackpot feature and a sequence of play of a game starts with all three wheels 22, 24, 26 of the jackpot feature rotating.

Figure 13:
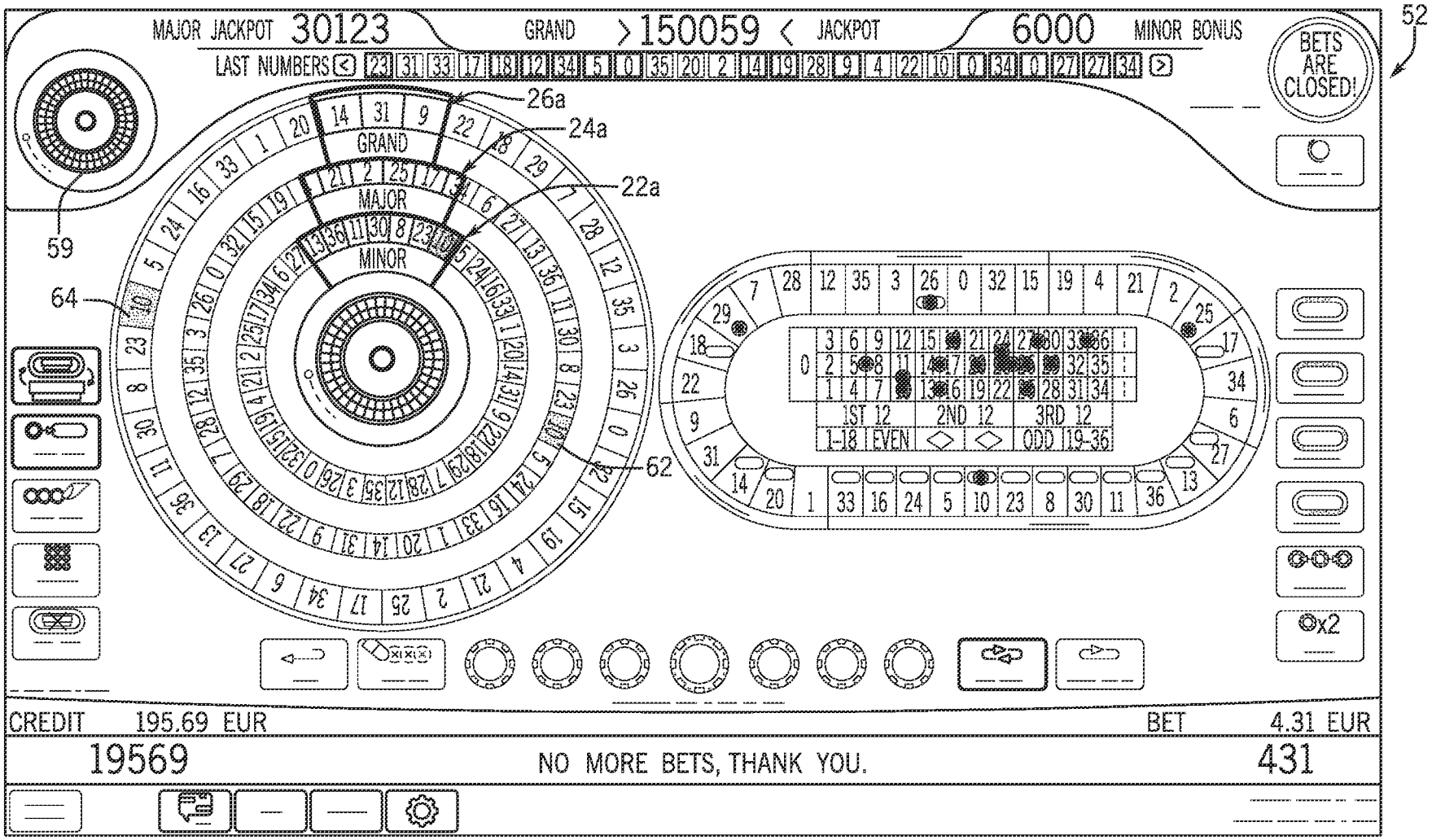
Figure 14:
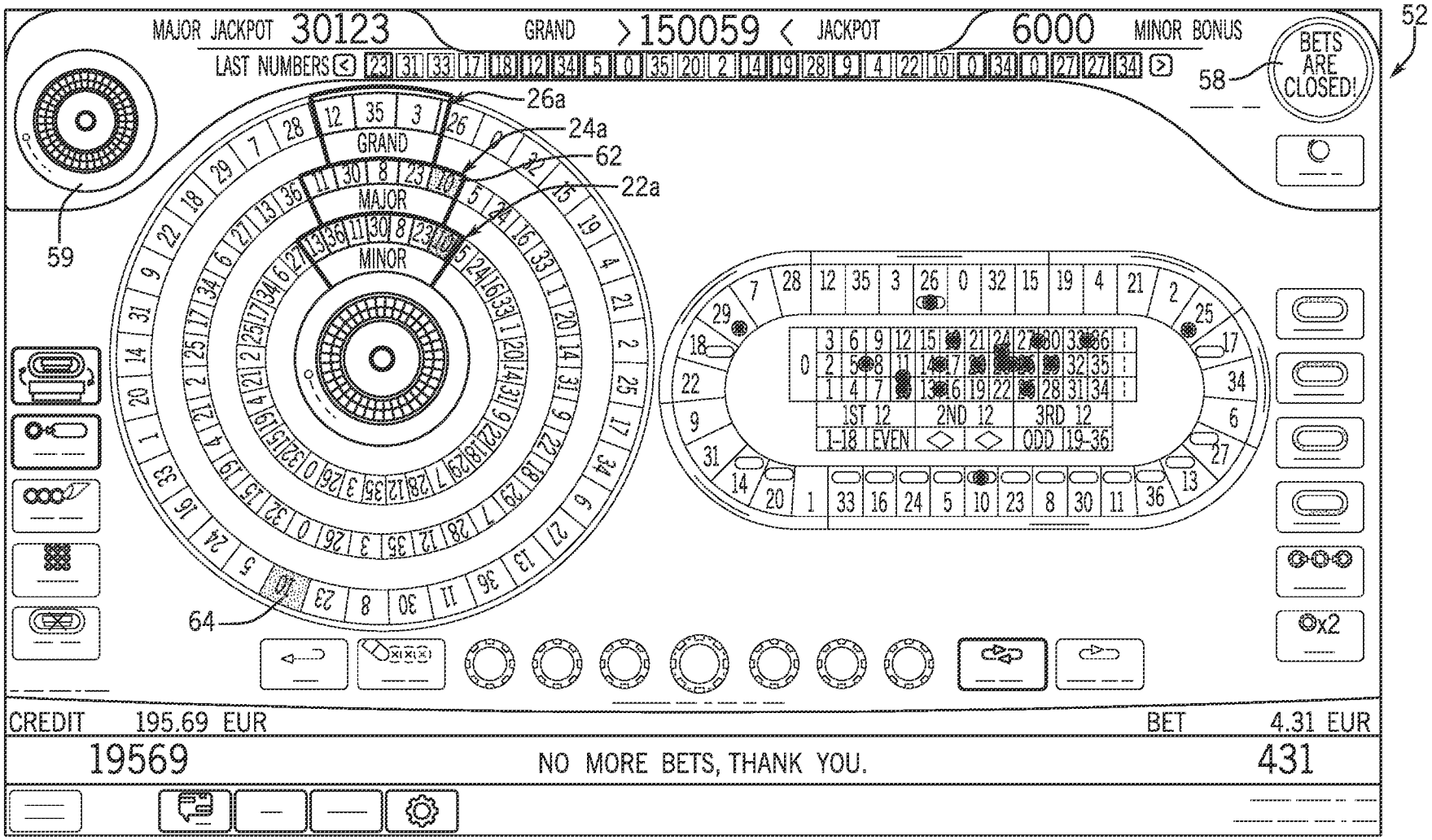
Figure 15:
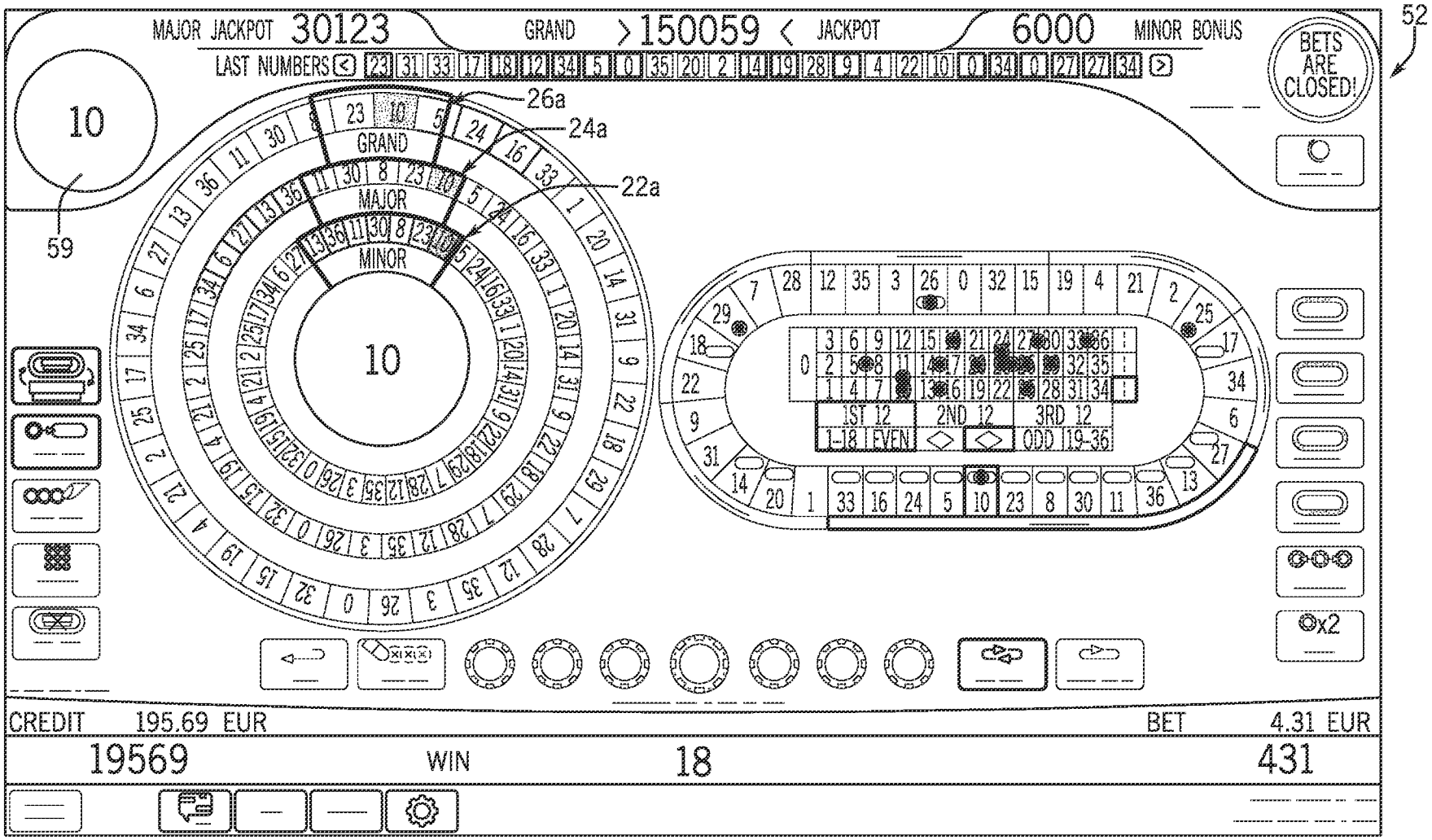
Figure 16:
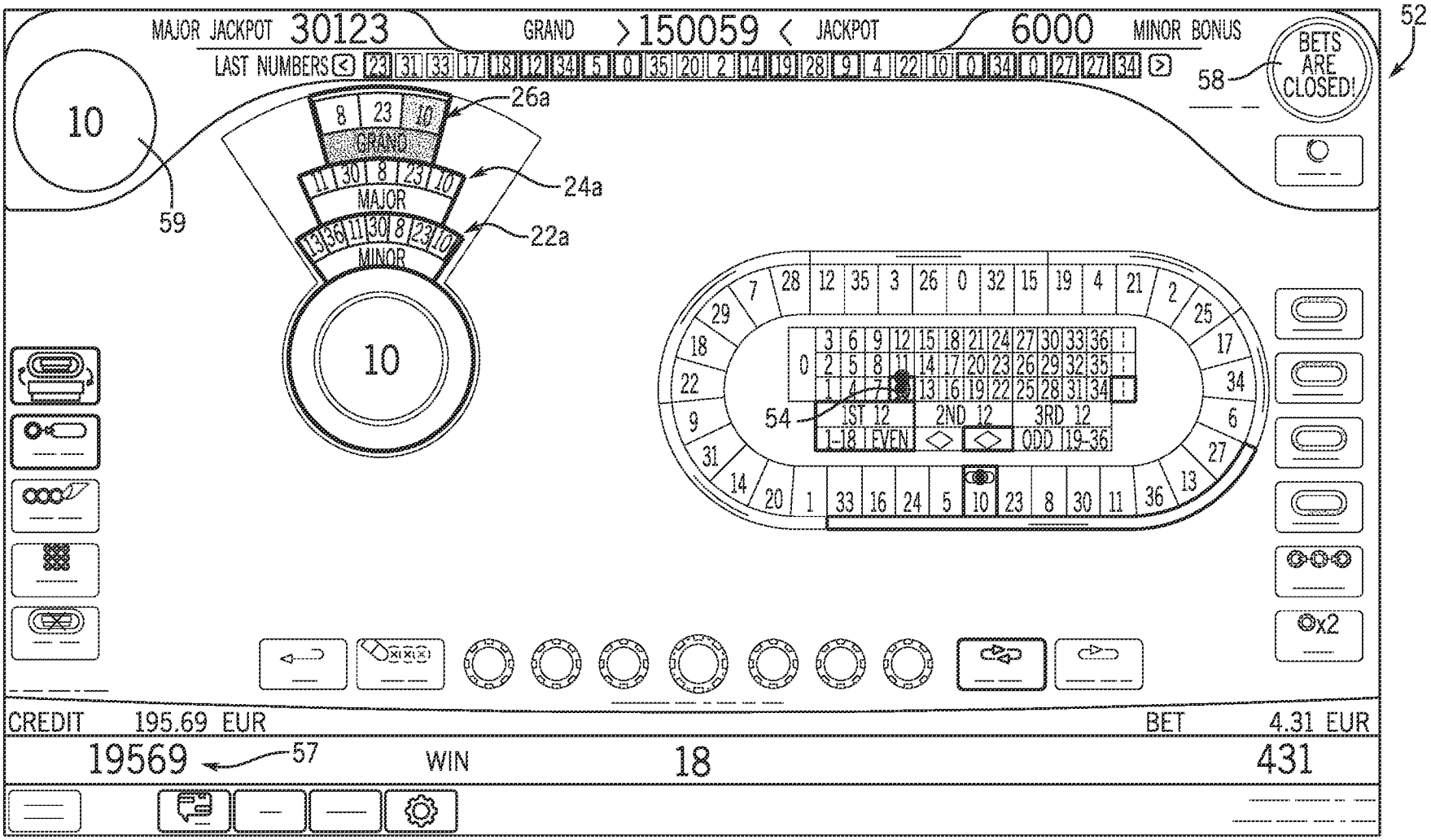
Figure 17:
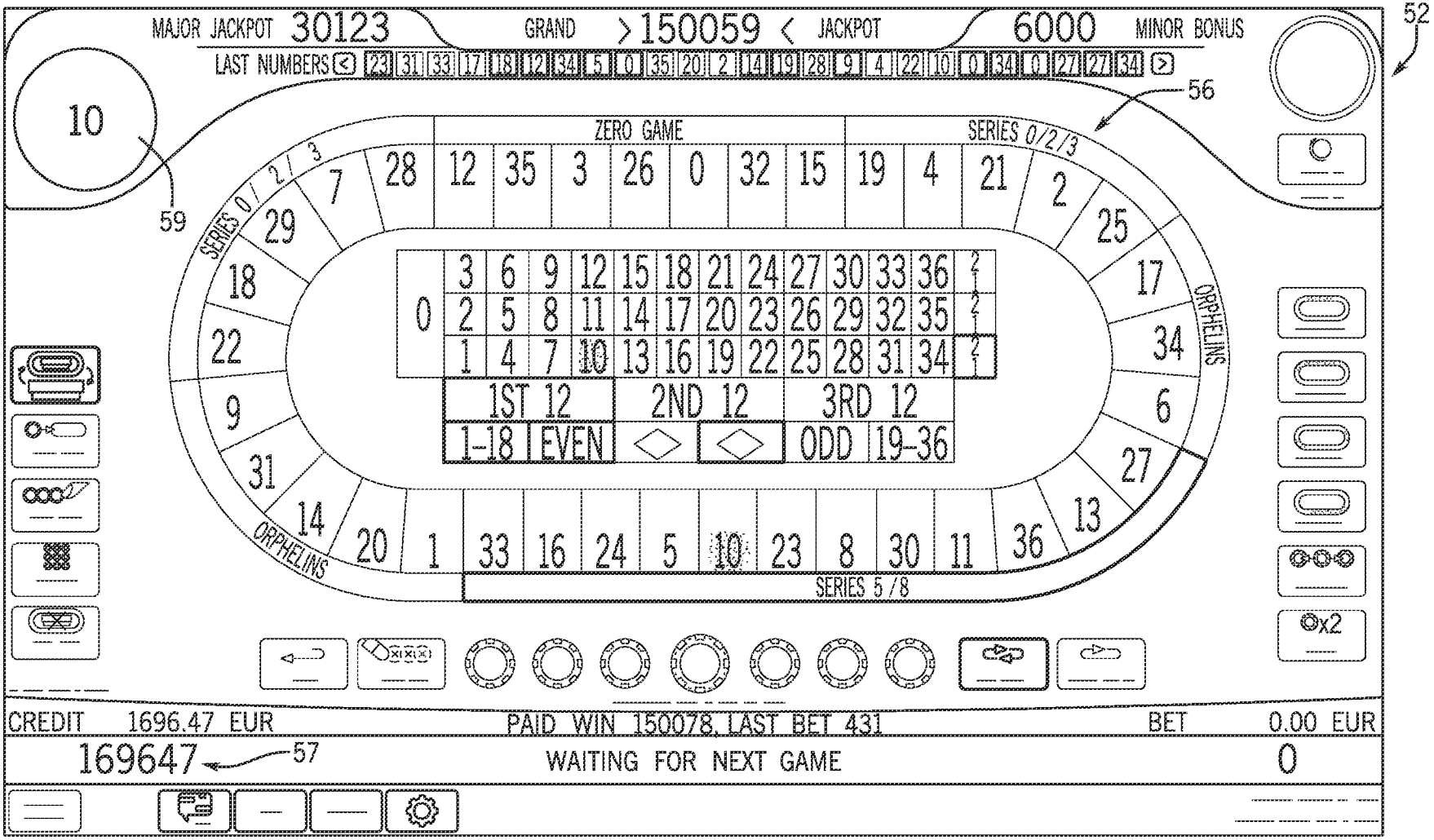

Turning now more specifically to a sequence of events that may occur during a game of chance played for the gaming system embodiment of FIGS. 12-17, each of FIGS. 13-17 include similar elements to those illustrated and described with respect to FIG. 12 and other embodiments discussed herein. It should therefore be appreciated that for ease of illustration, certain reference numerals have been omitted from FIGS. 13-17. In FIG. 13, first and third wheels 22, 26 have been rotated counterclockwise while second wheel 24 has been rotated clockwise. FIG. 13 illustrates that after said rotation, first wheel 22 is stopped, and the first subset of the set of unique symbols is displayed in MINOR window 22*a*. The symbols of the first subset of the set of unique symbols are qualified for a first award (i.e., MINOR jackpot). Here, the first subset contains only the single number "10" of the set of betted numbers "10", "25", "26", and "29". Player station display 52 highlights or indicates number "10" in MINOR window 22*a* as well as on second and third 24, 26 wheels as illustrated by reference numerals 62, 64 respectively. Like in FIGS. 1-11, while first wheel 22 has stopped and third wheel 26 is rotating, second wheel 24 slows down and is about to run out or stop. FIG. 14 illustrates second wheel 24 is stopped and the second subset of the set of unique symbols is displayed in MAJOR window 24*a*. The symbols of the second subset of the set of unique symbols that are also contained in the first subset of the set of unique symbols are qualified for a second award (i.e., MAJOR jackpot). Here, the number "10" of the set of betted numbers "10", "25", "26", and "29" is also contained in the second subset of the set of unique symbols. Therefore, player station display 52 highlights or indicates number "10" in MAJOR window 24*a* as well as on third wheel 26 as illustrated by reference numerals 64. FIG. 15 shows that while first wheel 22 and second wheel 24 are stopped, third wheel 26 slows down and is about to run out or stop. However, the roulette wheel of the roulette table has determined the winning number through the roulette ball that has landed in one of the possible fields (pockets of the roulette wheel). In this case the number "10" has been drawn, which is displayed in the respective roulette wheel display area 59 in the upper left corner of FIG. 15. A win in the amount of "18" has been determined based on the conventional roulette rules as illustrated in the bottom area of player station display 52. FIG. 16 shows that after the roulette draw, third wheel 26 is stopped and the third subset of the set of unique symbols are displayed in GRAND window 26*a*. The determined third subset of the set of unique symbols that are also contained in the first subset and the second subset of the set of unique symbols are qualified for a third award (i.e., GRAND jackpot). Here, the single number "10" of the set of betted numbers "10", "25", "26", and "29" is also contained in the third subset of the set of unique symbols. Therefore, player station display 52 highlights or indicates number "10" in GRAND window 26*a*. Because the drawn number "10" is also one of the symbols of the third subset of the set of unique symbols which is qualified for the third award, the GRAND jackpot bonus will be awarded (paid) to the player. FIG. 17 illustrates the gaming system after completion of the play of the game in which the player station display 52 (e.g., at a player station 50) displays an updated credit meter 57 in accord with the awarded GRAND jackpot bonus and a roulette betting field 56 waiting for the player to place a wager on a next play of the game.

Figure 18:
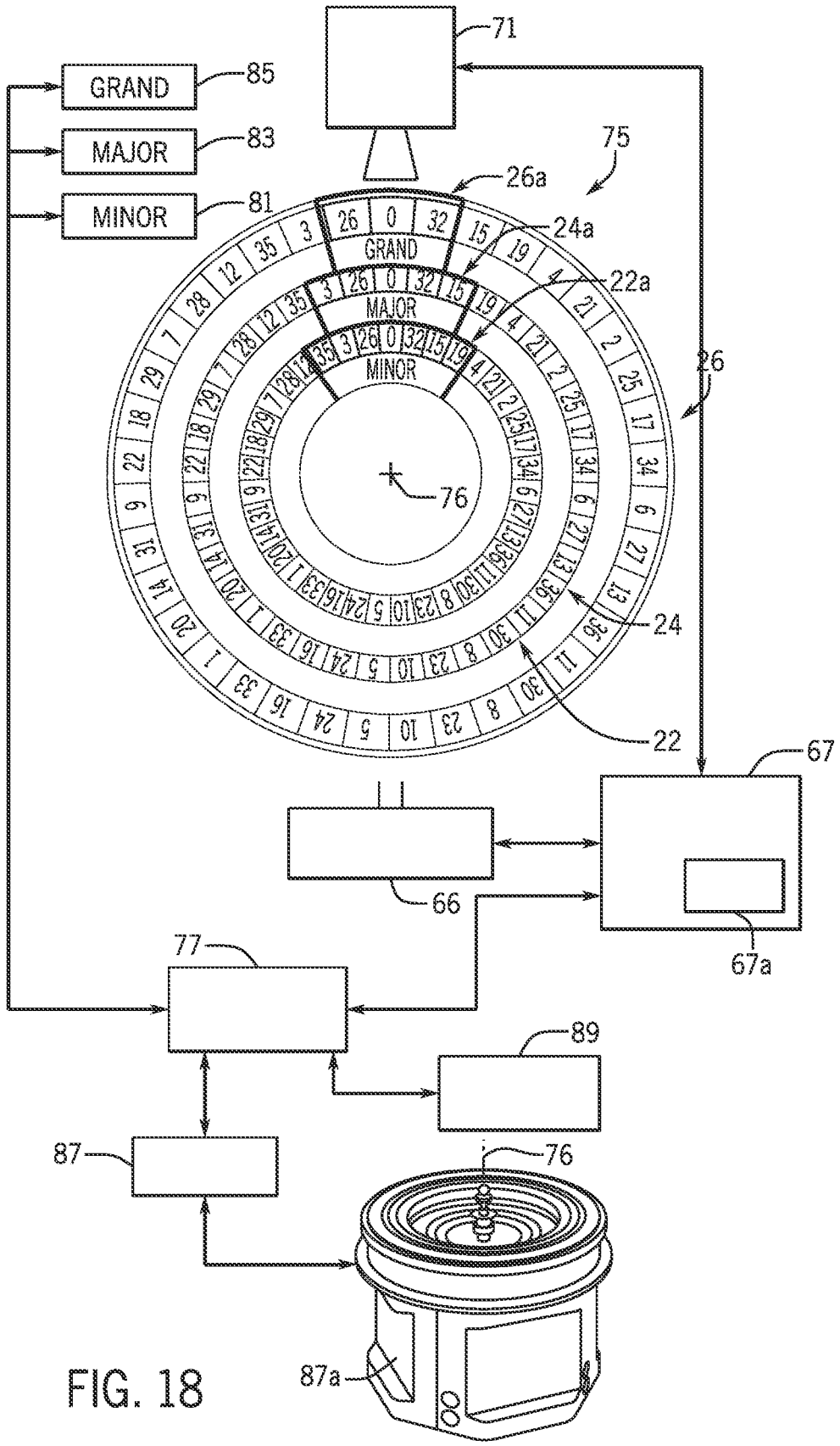
FIG. 18 is a schematic illustration of an additional embodiment of the gaming system of the present disclosure having a jackpot feature.

FIG. 18 illustrates part of an embodiment of a gaming system of the present disclosure having a jackpot feature comprising a physical or mechanical jackpot wheel 75 with three independently rotatable physical wheels 22, 24, 26 concentrically arranged with increasing diameters so that an outer circumference of each wheel 22, 24, 26 is visible. It should be appreciated that physical or mechanical jackpot wheel 75 of FIG. 18 may be used in combination with any of the gaming systems described herein. For example, the physical or mechanical wheel 75 of FIG. 18 and including its components may be used in addition to, or instead of, the jackpot feature and jackpot display having independent rotatable wheels described in the embodiment of FIGS. 1-11, and may be used in addition to, or alternative to, the jackpot feature and independently rotatable wheels described with respect to the embodiment of FIGS. 12-17. Like the gaming system embodiments described above, in FIG. 18, a set of unique symbols, e.g., numbers 0 to 36 according to U.K. (European) style roulette, is depicted (visible) on the outer circumference of each of the physical wheels 22, 24, 26. As illustrated, the sequence of the numbers on the outer circumference of each wheel is: 0-32-15-19-4-21-2-25-17-34-6-27-13-36-11-30-8-23-10-5-24-16-33-1-20-14-31-9-22-18-29-7-28-12-35-3-26. The jackpot wheel 75 further includes or is operative with a motor 66, and may include a gear and/or, for example, a centrifugal clutch or controllable catch between each of the three wheels 22, 24, 26. The gear and/or clutch enables wheels 22, 24, 26 to rotate independently from each other around a common axis 76 of rotation in the center of wheel 75. Motor 66 may be controlled by a jackpot control 67, which may include a motor driver interface in one example. Jackpot control 67 in some embodiments includes, for example, at least one processor and at least one memory device having instructions stored on the memory device for execution by the processor to control certain functions of the jackpot feature such as the spinning and stopping of the wheels. Jackpot control 67 may include any other suitable control elements or control system for operating, for example, the rotation and stopping of the wheels 22, 24, 26 and any other functions as described below. First and third wheels 22, 26 may be rotatable in a counterclockwise direction, and second wheel 24 may be rotatable in a clockwise direction. In the embodiment illustrated at FIG. 18, a video camera 71 is included and disposed in such a manner that allows recordation of the three rotatable wheels such that a respective circular segment of each of rotatable wheel 22, 24 and 26 is observable and recordable by camera 71.

Video camera 71 and any other video camera discussed herein may be any suitable type of video camera. For example, the video cameras herein may include a standard interlaced video camera operating at 60 fields per second (60 Hz), which equates to 30 full frames per second. Other suitable videos cameras may include cameras having higher resolution, greater low-light sensitivity or progressive scan (non-interlaced) output, which may have the benefit of image processing that is simpler because of the higher quality image such cameras may capture. The video camera may be adapted to detect light in the visible range.

In various embodiments, the rotatable wheels of any of the jackpot features or wheels described herein are adequately illuminated to facilitate image processing algorithms. For example, visible light emitting diodes ("LED's") may be mounted on or within one or more of the rotatable wheels to illuminate the wheels and provide a stable lighting environment for the video camera or any other suitable detector(s) to operate. In some embodiments, infra-red light and a camera may be used to detect wavelengths in the infra-red spectrum. A plurality of infra-red LEDs may be built into or otherwise on the wheels so that the gaming systems herein including the jackpot features function better in low visible-light conditions and which would advantageously allow lower-cost, less sensitive cameras to be used.

Referring again to video camera 71 of FIG. 18, camera 71 may be in communication with an image processor of jackpot control 67, and an electrical connection may couple video camera 71 to jackpot control 67 and the image processor. It should be understood that the image processor may be disposed in any suitable location, and in some embodiments may be remote from the rotatable wheels 22, 24, 26. For example, in one embodiment, the image processor wirelessly communicates with video camera 71. It should further be appreciated that the image processor may provide images to a symbol subset determination module

67*a*, e.g., a software module, that is configured to select a first subset of the set of unique symbols when the first wheel has stopped (MINOR window). It should be appreciated that the symbol subset determination module 67*a* may be based on a hardware logic circuitry, for instance comprising a counter triggered by a switch or light barrier or RFID tag for counting passing of symbol positions of the wheel (when rotating) starting from a defined reference symbol position. Here, the MINOR window comprises seven positions. Because of the fixed predetermined order of the symbol numbers arranged at each of the three wheels 22, 24, 26, there may be only one single number to be determined and its position within the MINOR window 22*a* to determine the remaining numbers within the MINOR window 22*a*. The set of symbols within the MAJOR window 24*a* and GRAND window 26*a* may be determined likewise. Each of the unique symbols of the rotatable wheel 75 may be selectively illuminated in various embodiments, (e.g. corresponding to, for example, LEDs associated with each unique symbol position). Jackpot control 67 is adapted to control that if the first rotatable wheel 22 is stopped and the first subset of the set of unique symbols is determined in the MINOR window 22*a*, the determined numbers are propagated to be highlighted on the second rotatable wheel and on the third rotatable wheel while the second and third wheels are still rotating (as discussed above). The symbols of the first subset of the set of unique symbols are qualified for a first award (i.e., MINOR jackpot). Jackpot control 67 is further adapted to control that if second rotatable wheel is stopped, the second subset of the set of unique symbols is determined in the MAJOR window 24*a*. Those symbols of the second subset of the set of unique symbols that are also contained in the first subset of the set of unique symbols are qualified for a second award (i.e., MAJOR jackpot). Jackpot control 67 is further adapted to control that if the third rotatable wheel is stopped, the third subset of the set of unique symbols is determined in the GRAND window 26*a*. The symbols of the third subset of the set of unique symbols that are also contained in the first subset and the second subset of the set of unique symbols are qualified for a third award (i.e., GRAND jackpot).

The jackpot feature or system of FIG. 18 may in various embodiments include a system control 77 operatively coupled to jackpot control 67 and to the MINOR, MAJOR, and GRAND jackpot meters or displays 81, 83, 85, respectively. System control 77 may include, for example, at least one processor and at least one memory device having instructions stored on the memory device for execution by the processor to control functions of the roulette game play (including credit handling) and/or jackpot feature, and may be communicatively coupled with a roulette wheel draw control 87 and a bet control 89 for handling the roulette random number draw and the roulette betting handling, respectively. Likewise roulette wheel draw control 87 and bet control 89 each include, for example, at least one processor and at least one memory device having instructions stored on the memory device for execution by the processor to control functions of the jackpot feature. The roulette wheel draw control 87 comprises and operates the roulette wheel 87*a* as conventionally known. If the roulette wheel of the roulette table has determined the (random) winning number through the roulette ball that has landed in one of the possible fields (i.e. one of pockets of the roulette wheel) and if a unique symbol which is qualified for an award (as determined by the jackpot control) are matching, then the respective MINOR, MAJOR, or GRAND jackpot bonus will be awarded (paid) to the respective player(s) who has/have placed the Jackpot chip to the respective number at the betting field.

According to a further embodiment, the roulette wheel may be arranged within the first inner rotatable wheel 22, e.g., has a smaller circumference and is rotatable independently from the other rotatable wheels 22, 24, 26 around the common axis 76 of rotation in the center of wheel 75. Advantageously, the motor 66 may drive also the roulette wheel in addition to the rotatable wheels 22, 24, 26. In this case further advantageously the camera 71 and corresponding image processor are additionally adapted to determine the pocket of the roulette wheel where the roulette ball has landed to determine the (random) winning number.

According to a further embodiment, the roulette ball operated roulette wheel of the embodiments above may be replaced by a pseudo random number generator (PRNG) to determine the winning number.

What is claimed is:

1. A gaming machine for playing a game of chance, the gaming machine comprising:

one or more player stations arranged in a table configuration, wherein a player station of the one or more player stations comprises player-activatable input devices for receiving player input by a player of the player station;

an acceptor for receiving a wager and establishing a credit balance of a player of the player station of the one or more player stations, the credit balance increasable and decreasable based at least on wagering activity;

a payout mechanism configured to payout the credit balance to the player of the player station of the one or more player stations;

a credit meter configured to monitor the credit balance of the player of the player station of the one or more player stations;

a display arrangement for displaying the game of chance to players of the one or more player stations; and a processor, wherein the processor, in accordance with the credit balance, executes game software instructions to process player input from the player-activatable input devices, and operate with the display arrangement so that, for each time the game of chance is played, the display arrangement shows:

two or more rotatable wheels that are concentrically arranged and have increasing diameters so that an outer circumference of each of the two or more rotatable wheels is visible, a set of unique symbols on the outer circumference of each of the two or more rotatable wheels, and wherein each of the two or more rotatable wheels rotates independently from each of the other two or more rotatable wheels, a first wheel of the two or more rotatable wheels comprises a first number of positions on the outer circumference of the first wheel for selecting a first subset of the set of unique symbols if the first wheel has stopped, a second wheel of the two or more rotatable wheels comprises a second number of positions on the outer circumference of the second wheel for selecting a second subset of the set of unique symbols if the second wheel has stopped, the second number of positions smaller than the first number of positions, and further comprising a first selection window comprising the first number of positions on the outer circumference of the first wheel, and a second selection window comprising the second number of positions on the outer circumference of the second wheel, wherein the processor comprises a symbol subset determination module to determine the first subset of the set of unique symbols of the first wheel and the second subset of the set of unique symbols of the second wheel, and to determine that symbols of the second subset of the set of unique symbols that are also contained in the first subset of unique symbols are qualified for an award, and wherein the processor is configured to execute the game software instructions to control rotation and stopping of the two or more wheels, wherein the rotation of the first and second wheels occurs concurrently, and wherein the rotation of the first and second wheels is stopped in sequence.

2. The gaming machine according to claim 1, wherein: each set of unique symbols includes a total number of symbols, the first number of positions on the outer circumference of the first wheel are less than the total number of symbols of the set of unique symbols on the outer circumference of the first wheel and are contiguously arranged in a first block, and the second number of positions on the outer circumference of the second wheel are less than the total number of symbols of the set of unique symbols on the outer circumference of the second wheel and are contiguously arranged in a second block.

3. The gaming machine according to claim 1, wherein the symbol subset determination module is configured to determine the first subset of the set of unique symbols of the first wheel if the first wheel is stopped and the second wheel is rotating, and to determine the second subset of the set of unique symbols of the second wheel if the first wheel and the second wheel are stopped.

4. The gaming machine according to claim 1, wherein the set of unique symbols is depicted on the circumference of each wheel of the two or more rotatable wheels in the same order.

5. The gaming machine according to claim 1, wherein the set of unique symbols corresponds to symbols of a roulette game.

6. The gaming machine according to claim 1, wherein the processor is configured to execute game software instructions to highlight symbols on the second wheel corresponding to the first subset of unique symbols while the first wheel is stopped and the second wheel is rotating.

7. The gaming machine according to claim 1, wherein the processor is configured to execute game software instructions to highlight symbols of the second subset of the set of unique symbols that are also contained in the first subset of unique symbols while the first wheel and the second wheel are stopped.

8. The gaming machine according to claim 1, further comprising a random number generator ("RNG"), wherein a single symbol of the set of unique symbols is randomly determined by the RNG, wherein the processor is configured to determine whether the determined single symbol determined by the RNG matches one of the symbols that are qualified for an award, and wherein the single symbol is qualified for a first award if the single symbol is contained in the first subset of the set of unique symbols.

9. The gaming machine according to claim 8, wherein the RNG is a mechanical roulette wheel operated with at least one roulette ball, wherein the display arrangement is configured to display a single symbol determined by the roulette ball landing in a pocket of the mechanical roulette wheel.

10. The gaming machine according to claim 8, wherein the RNG is a pseudo RNG ("PRNG"), wherein the display arrangement is configured to show the roulette wheel as a simulated wheel in the display arrangement, and to display a single symbol determined by the pseudo RNG.

11. The gaming machine according to claim 8, wherein the single symbol is qualified for a second award if the single symbol is contained in the first and second subset of the set of unique symbols.

12. The gaming machine according to claim 11, wherein the processor comprises an image processor in communication with a camera, wherein the image processor is configured to determine the pocket of the roulette wheel where the roulette ball has landed to enable the determination of the single symbol.

13. The gaming machine according to claim 11, wherein the processor is configured to award the first award to the player if the player input matches the single symbol qualified for the first award, and to award the second award to the player if the player input matches the single symbol qualified for the second award.

14. A gaming system for playing a game of chance, the gaming system comprising:

one or more player stations arranged in a table configuration, wherein a player station of the one or more player stations comprises player-activatable input devices for receiving player input by a player of the player station;

two or more mechanical wheels that are rotatable and concentrically arranged and have increasing diameters so that an outer circumference of each of the two or more rotatable wheels is visible, and a set of unique symbols on the outer circumference of each of the two or more rotatable wheels;

a controller configured to control a motor for driving rotation and stopping of the two or more rotatable wheels; wherein each of the two or more rotatable wheels rotates independently from each of the other two or more rotatable wheels, wherein a first wheel of the two or more rotatable wheels comprises a first number of positions on the outer circumference of the first wheel for selecting a first subset of the set of unique symbols if the first wheel has stopped, wherein a second wheel of the two or more rotatable wheels comprises a second number of positions on the outer circumference of the second wheel for selecting a second subset of the set of unique symbols if the second wheel has stopped, the second number of positions smaller than the first number of positions;

wherein the controller comprises a symbol subset determination module for determining the first subset of the set of unique symbols of the first wheel if the first wheel has stopped and the second subset of the set of unique symbols of the second wheel if the second wheel has stopped, wherein the symbols of the second subset of the set of unique symbols that are also contained in the first subset of unique symbols are qualified for an award, wherein the controller is configured to control rotation and stopping of the two or more wheels, wherein the rotation of the first and second wheels occurs concurrently, and wherein the rotation of the first and second wheels is stopped in sequence, and further comprising a first selection window comprising the first number of positions on the outer circumference of the first wheel, and a second selection window comprising the second number of positions on the outer circumference of the second wheel.

15. The gaming system according to claim 14, wherein the symbol subset determination module comprises one or more sensors to determine the first subset of the set of unique symbols and the second subset of the set of unique symbols.

16. The gaming system according to claim 14, wherein the controller comprises an image processor in communication with a camera for capturing images of the two or more rotatable wheels, wherein the image processor is configured to provide images to a symbol subset determination module of the controller to determine the first subset of the set of unique symbols in the first number of positions if the first wheel has been stopped by the controller.

17. The gaming system according to claim 14, further comprising a system controller and a random number generation (RNG) controller, wherein the system controller is in communication with the controller and the RNG controller, wherein the RNG controller is configured to control an operation of a RNG comprising a mechanical roulette wheel operated with at least one roulette ball, and wherein the system controller is configured to determine whether a single symbol determined by the RNG matches one of the symbols that are qualified for an award.

18. A method for operating a game of chance of a gaming machine comprising (a) one or more player stations arranged in a table configuration, wherein a player station of the one or more player stations comprises player-activatable input devices for receiving player input by a player of the player station, (b) an acceptor for receiving a wager and establishing a credit balance of a player of the player station of the one or more player stations, the credit balance increasable and decreasable based at least on wagering activity, (c) a payout mechanism configured to payout the credit balance to the player of the player station of the one or more player stations, (d) a credit meter configured to monitor the credit balance of the player of the player station of the one or more player stations; (e) a display arrangement for displaying the game of chance to players of the one or more player stations, the method comprising the steps:

rotating two or more rotatable wheels independently from each other and concurrently with each other, the two or more rotatable wheels concentrically arranged and having (i) increasing diameters so that an outer circumference of each of the two or more rotatable wheels is visible, and (ii) a set of unique symbols on the outer circumference of each of the two or more rotatable wheels; and stopping the first wheel of the two or more rotatable wheels, the first wheel further comprising a first number of positions on the outer circumference of the first wheel, wherein a first selection window of the gaming machine comprises the first number of positions on the outer circumference of the first wheel;

selecting from the first number of positions on the outer circumference of the first wheel a first subset of the set of unique symbols when the first wheel is stopped;

stopping the second wheel of the two or more rotatable wheels, the second wheel further comprising a second number of positions on the outer circumference of the second wheel, the second number of positions smaller than the first number of positions, wherein said stopping of the first and said stopping of the second wheel occurs in sequence, and wherein a second selection window of the gaming machine comprises the second number of positions on the outer circumference of the second wheel;

selecting from the second number of positions on the outer circumference of the second wheel a second subset of the set of unique symbols when the second wheel is stopped; and qualifying for an award when the symbols of the second subset of the set of unique symbols are also contained in the selected first subset of unique symbols.

19. The method for operating a game of chance according to claim 18, further comprising:

providing a random number generator ("RNG") and determining randomly a single symbol of the set of unique symbols; and qualifying for a first award when the randomly determined single symbol is contained in the first subset of the set of unique symbols.

20. The method for operating a game of chance according to claim 19, further comprising:

qualifying for a second award when the single symbol is contained in the first and second subset of the set of unique symbols.

21. The method for operating a game of chance according to claim 19, wherein said RNG is a mechanical roulette wheel and determining randomly the single symbol of the set of unique symbols is via the mechanical roulette wheel operated with at least one roulette ball.

* * * * *